US006568877B1

(12) United States Patent
Behrens

(10) Patent No.: US 6,568,877 B1
(45) Date of Patent: May 27, 2003

(54) DELINEATOR POLE AND MOWER ATTACHMENT

(76) Inventor: Donald F. Behrens, 258 Cambridge Dr., Dimondale, MI (US) 48821

( * ) Notice: Subject to any disclaimer, the term of this patent is extended or adjusted under 35 U.S.C. 154(b) by 10 days.

(21) Appl. No.: 10/039,132

(22) Filed: Jan. 2, 2002

Related U.S. Application Data

(60) Provisional application No. 60/259,654, filed on Jan. 4, 2001.

(51) Int. Cl.[7] ..... E01F 9/00; G09F 15/00

(52) U.S. Cl. ..... 404/10; 404/9; 116/63 R; 40/607; 40/612

(58) Field of Search ..... 404/9, 10; 116/63 R; 40/606, 607, 612

(56) References Cited

U.S. PATENT DOCUMENTS 2,976,000 A * 3/1961 Gunderson ..... 248/156
3,847,497 A * 11/1974 Guillory, Sr. ..... 404/10
4,205,472 A * 6/1980 Shirley ..... 40/608
4,751,801 A * 6/1988 Andersson ..... 52/98
4,908,249 A * 3/1990 Lines ..... 428/36.9
5,125,194 A * 6/1992 Granger ..... 52/98
5,238,322 A * 8/1993 Stirtz ..... 404/10
5,484,217 A * 1/1996 Carroll et al. ..... 403/2
5,613,799 A * 3/1997 Guide ..... 404/9

* cited by examiner

*Primary Examiner*—Gary S. Hartmann
(74) *Attorney, Agent, or Firm*—Mary M. Moyne; Ian C. McLeod

(57) ABSTRACT

A delineator pole (10) includes a top portion (10A), a center portion (10C) and a bottom portion (10B) and is intended to be rotatably mounted in the ground (50) adjacent a road. When a bumper contacts the delineator pole the bumper rotates the delineator pole.

7 Claims, 7 Drawing Sheets

DELINEATOR POLE AND MOWER ATTACHMENT

CROSS-REFERENCE TO RELATED APPLICATION

This application claims the benefit of U.S. Provisional Applicaion No.: 60/259,654 Jan. 4, 2001

STATEMENT REGARDING FEDERALLY SPONSORED RESEARCH OR DEVELOPMENT

Not Applicable

BACKGROUND OF THE INVENTION

1. Field of the Invention

The present invention relates to a delineator pole which mounts along an edge of the road to indicate the edge of the road and a mower attachment for attaching to a mowing vehicle for rotating the delineator pole into a position which allows the mowing vehicle to mow on both sides of the delineator pole.

2. Description of the Related Art

Delineator poles are positioned along the edge of a road to provide indicators for snow plow drivers to use to locate the edge or side of the road or to determine the off-road position. In the past, the delineator poles were fixed linear poles. These fixed poles create a problem in the spring, summer and fall for mowing vehicles trying to mow or cut grass along the side of the road. The delineator poles have a significant height, as necessary to extend above standard snow fall, thus the mowing vehicles are unable to pass over the delineator poles. One solution is to remove the delineator poles. However, this requires installing new delineator poles before each winter. Another solution is to mow around the delineator pole. However, with a stationary, fixed delineator pole, the mowing vehicle must make a first pass on one (1) side of the delineator pole and then return for a second pass on the other side of the delineator pole. A string trimmer or other cutting device is then used to thoroughly cut the grass around all sides of the delineator pole. The previous solutions are both time consuming and expensive. In addition, the delineator poles are often damaged during removal, reinstallation or during mowing.

There remains the need for a delineator pole which can indicate the edge of the road but which can be moved such as to allow a mowing vehicle to mow along the edge of the road in a single pass while the delineator pole remains in position. Further, there remains a need for a mower attachment which moves the delineator pole out of the path of the mowing vehicle without effecting the indicator ability of the delineator pole.

SUMMARY OF THE INVENTION

The present invention relates to a delineator pole and a mower attachment for turning the delineator pole. The delineator pole includes a first portion, second portion and a third portion. The delineator pole is intended to be rotatably mounted in the ground adjacent a road. The third portion is connected to the first and second portions by an upper portion and a lower portion. The upper and lower portions position the third portion a distance from the first and second portions such as to form a pass-through. The second portion of the delineator pole can be provided with an anchor sleeve to prevent removal of the delineator pole from the ground. The first portion can be provided with an indicator so that the delineator pole is easy to locate. The delineator poles are positioned adjacent a road to indicate a side or edge of the road. The delineator poles are rotated out of the path of a mowing vehicle to prevent damage to the delineator pole and to allow the mowing vehicle to completely mow around the delineator pole. The mowing vehicle is provided with a mower attachment in front of or proceeding each offset mowing device. The mowing attachment includes a bracket for mounting the mower attachment on the mowing vehicle or on the mowing device. The mowing attachment also includes a bumper connected to the bracket by first, second and third connector rods. The connector rods are flexible and resilient such that when the bumper contacts the delineator pole to rotate the delineator pole, the connector rods flex to enable the bumper to turn the delineator pole. Once contact with the delineator pole ceases, the connector rods move back to their original position. The bumper can be provided with an outer cover to prevent damage to the delineator pole during rotation. The mower attachment may also be provided with a position indicator to enable an operator of the mowing vehicle to easily determine the position of the mower attachment.

The present invention relates to a delineator pole for use adjacent an edge of a road to indicate the edge of the road, which comprises: a first portion having a first end and a second end; a second portion spaced apart from and coaxial with the first portion and having a first end and a second end; and a third portion having a first leg, a second leg and a center portion each leg having a first end and a second end with the center portion extending between the second end of the first leg and the second end of the second leg such that the third portion has a U-shape wherein the first end of the first leg is connected to the second end of the first portion and the first end of the second leg is connected to the first end of the second portion and wherein in use, the second portion is inserted in ground adjacent the edge of the road such that the second leg of the third portion is adjacent the ground wherein the delineator pole is configured to rotate in the ground such that a mowing vehicle will move along the edge of the road and rotate the delineator pole to allow the mowing vehicle to move through the third portion of the delineator pole to mow along the edge of the road without damaging the delineator pole and wherein when the delineator pole rotates, the first portion of the delineator pole continues to indicate the edge of the road.

Further, the present invention relates to a mower attachment for rotating a delineator pole which indicates an edge of a road for use with a mowing vehicle used adjacent the edge of the road, which comprises: a bracket configured for mounting the mower attachment on the mowing vehicle; a flexible connector rod having opposed ends with one end connected to the bracket and extending outward away from the bracket toward the other end; and a bumper mounted on the other end of the flexible connector rod wherein in use, the mowing vehicle moves toward the delineator pole and the bumper of the mower attachment contacts the delineator pole and rotates the delineator pole such that the mower attachment moves past the delineator pole without damaging the delineator pole.

Still further, the present invention relates to a vehicle for mowing grass adjacent an edge of a road, the improvement which comprises: a mower attachment for rotating a delineator pole which indicates the edge of the road, the mower attachment including: a bracket for mounting the mower attachment on the vehicle; a flexible connector rod having opposed ends with one end connected to the bracket and extending outward from the bracket; and a bumper mounted on the other end of the flexible connector rod.

Further still, the present invention relates to a method for mowing grass along an edge of a road, which comprises the steps of: providing a mowing vehicle having a mowing device; providing a delineator pole adjacent the edge of the road to indicate the edge of the road; providing a mower attachment on the mowing vehicle, the attachment including a flexible connector rod having opposed ends with one end connected to the mowing vehicle and extending outward away from the mowing vehicle toward the other end; and a bumper mounted on the other end of the flexible connector rod; and driving the mowing vehicle along the edge of the road to mow along the edge of the road wherein, the mower attachment contacts the delineator pole and rotates the delineator pole to allow the mowing device to move past the delineator pole without damaging the delineator pole.

The substance and advantages of the present invention will become increasingly apparent by reference to the following drawings and the description.

DESCRIPTION OF THE PREFERRED EMBODIMENTS

Figure 1:
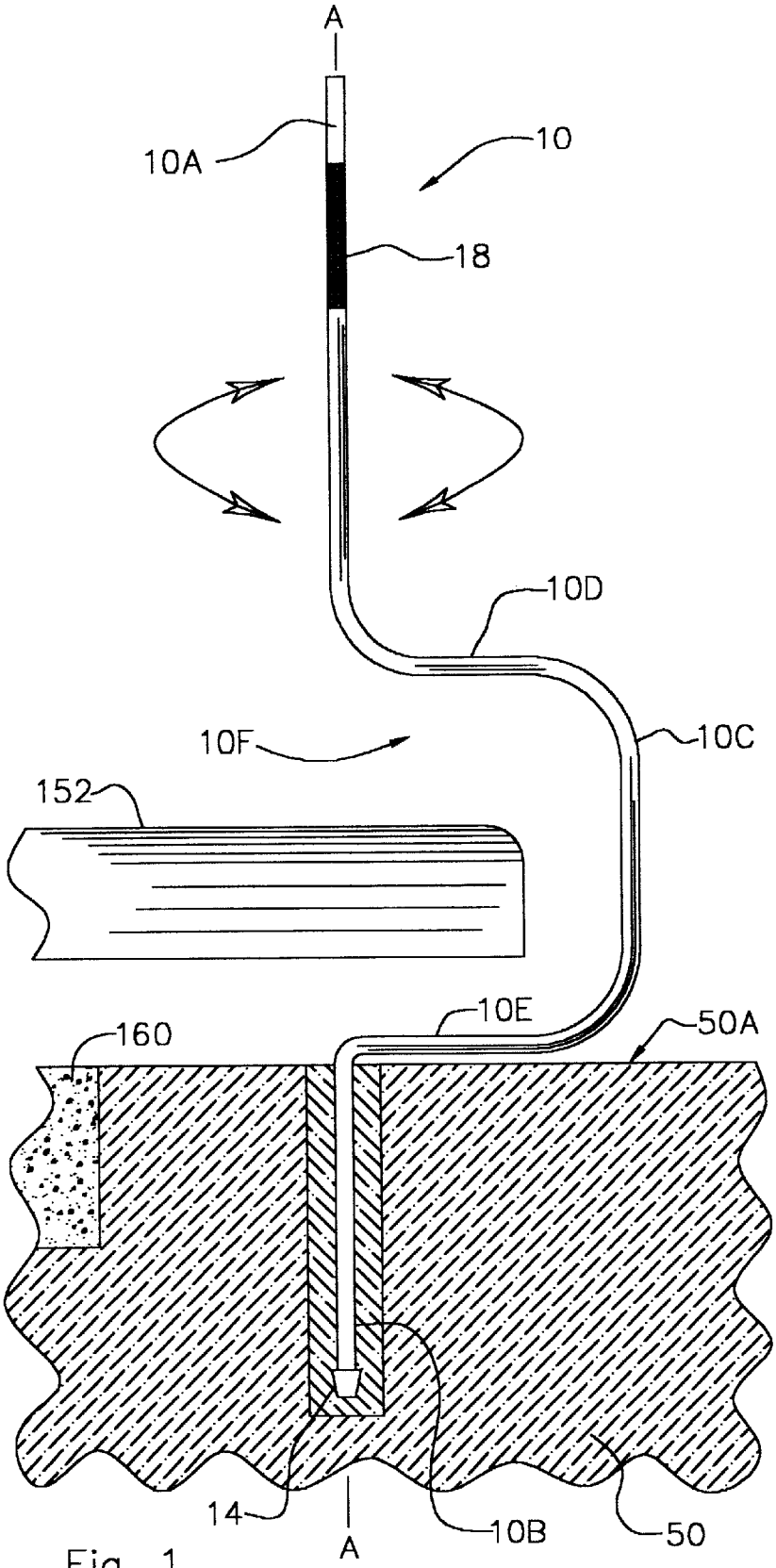
FIG. 1 is a side view of the delineator pole 10 of the present invention mounted adjacent the edge of a road 160.
Figure 2:
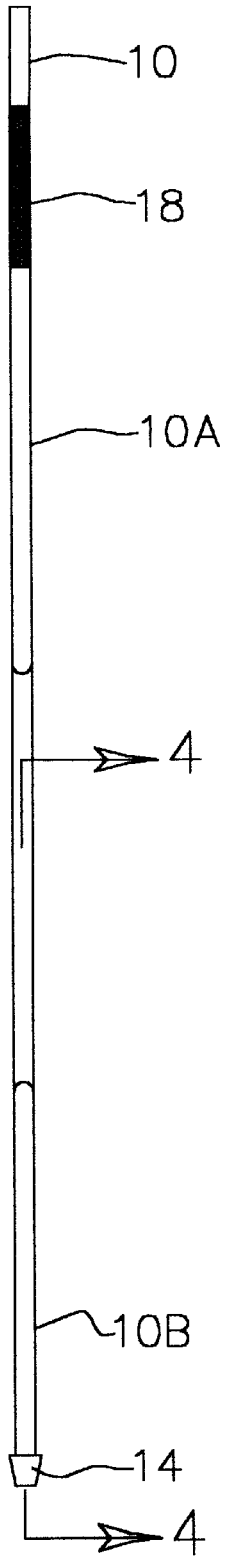
FIG. 2 is a front view of the delineator pole 10.
Figure 3:
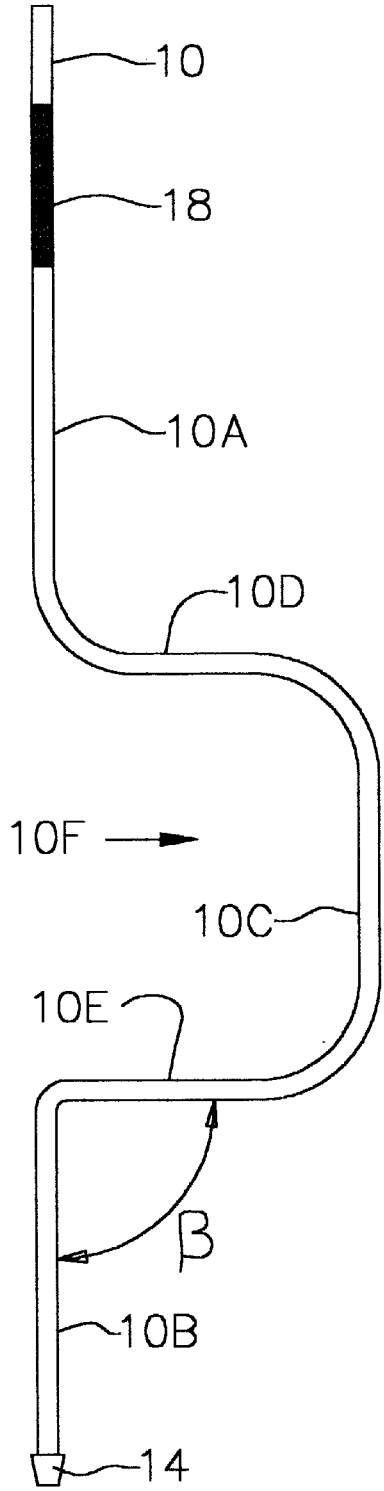
FIG. 3 is a side view of the delineator pole 10.
Figure 4:
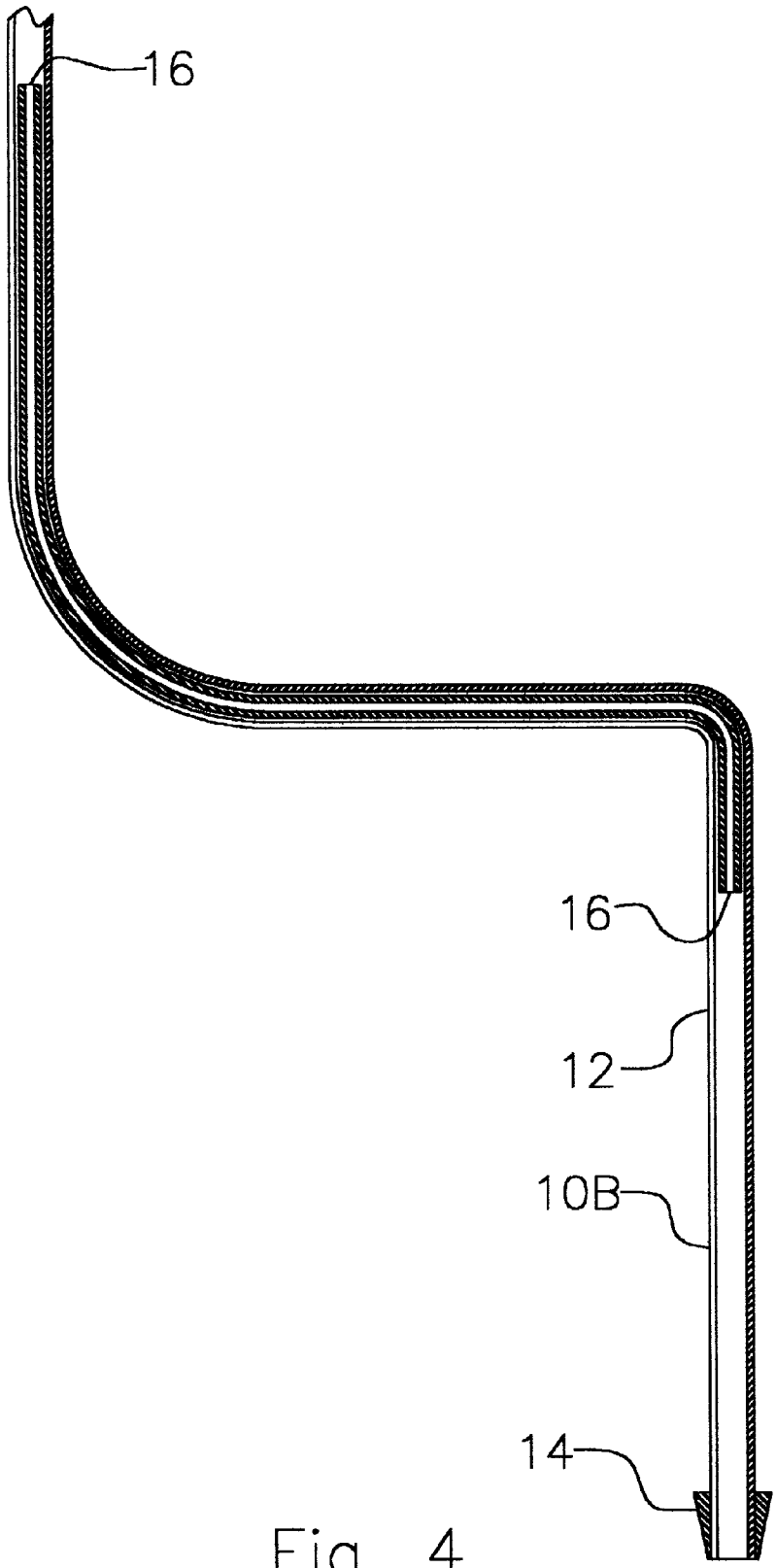
FIG. 4 is a partial cross-sectional view along the line 4—4 of FIG. 2 showing the hollow tube 12 and the inner rod 16.

FIGS. 1 to 4 show the delineator pole 10 of the present invention. The delineator pole 10 includes a first top portion 10A, a second bottom portion 10B and a third center portion 10C. The top portion 10A and the bottom portion 10B are preferably aligned and form the longitudinal axis A—A of the delineator pole 10 (FIG. 1). An upper portion 10D extends between the second end of the top portion 10A and the first end of the center portion 10C. A lower portion 10E extends between the second end of the center portion 10C and the first end of the bottom portion 10B. The upper and lower center portions 10D and 10E extend outward from the center portion 10C in the same direction and form a square, U-shaped crank opening or pass-through 10F. The upper and lower center portions 10D and 10E preferably form an essentially 90° angle with the portions 10A, 10B and 10C. The upper and lower center portions 10D and 10E preferably have a similar length such that the center portion 10B is parallel to the top and bottom portions 10A and 10C. The upper and lower portions 10D and 10E preferably have an identical length such that the top portion 10A is co-axial with the bottom portion 10B. In one (1) embodiment, the upper and lower portions 10D and 10E have a length of 16 inches (41 cm). In one (1) embodiment, an angle β (FIG. 3) between the bottom portion 10B and the lower center portion 10E is sharper and less rounded than the other three (3) corners. The delineator pole 10 is reinforced at the bends or corners possibly by heat treatment. In one (1) embodiment, the delineator pole 10 is constructed of a hollow rod or tube 12 (FIG. 4). Metal electrical conduit could be used. In this embodiment, to reinforce the corners, the bottom corner between the bottom portion 10B and the lower center portion 10E could be crimped on one (1) or on both sides. The corner can be crimped by forming a longitudinal groove on the inside and outside of the corner. An inner rod 16 could also be provided within the hollow tube 12 to provide additional strength to the delineator pole 10 (FIG. 3). In one (1) embodiment, the inner rod 16 is provided only at the corners. The delineator pole 10 has a circular cross-section which allows for easier rotation of the delineator pole 10 in the ground 50. The delineator pole 10 preferably has a galvanized finish to protect the delineator pole 10 from damage from the environment.

In one (1) embodiment, the delineator pole 10 is constructed from a single piece of tubing 12 having an inner diameter of 0.75 inches (1.91 cm) and a total length of approximately 98 inches (249 cm). The single piece of tubing 12 is bent into the correct shape. In the one (1) embodiment, the top portion 10A has a length of about 31 inches (79 cm), the third center portion 10C has a length of about 20 inches (51 cm) and the second bottom portion 10B has a length of about 20 inches (51 cm). The length of the center portion 10B is such as to allow a standard mower deck to easily move between the upper and lower portions 10D and 10E of the delineator pole 10. The height of the delineator pole 10 above the ground 50 is such that the first end of the first top portion 10A is visible after an average snowfall. The height of the delineator pole 10 will vary depending on the average snowfall of the area in which the delineator pole 10 is installed. In one (1) embodiment, when the delineator pole 10 is mounted in the ground 50, the delineator pole 10 has a height above the ground surface 50A of approximately 50 to 52 inches (127 to 132 cm). In one (1) embodiment, the height of the delineator pole 10 is such that a light reflector 18 is visible after a standard snowfall.

In an alternative embodiment (not shown), the delineator pole has a top portion, a bottom portion, a curved center portion and a horizontal center portion. The curved center portion extends between the second end of the top portion and the first end of the horizontal center portion. The horizontal center portion extends between the second end of the curved center portion and the first end of the bottom portion. The horizontal A center portion is preferably connected to the bottom portion at a sharp, essentially 90° angle. Thus, when the delineator pole is installed in the ground 50, the second end of the bottom portion is in the ground 50 such that the horizontal center portion is adjacent and parallel to the ground surface 50A. Preferably, the space between the horizontal center portion and the ground surface 50A is such as to allow the delineator pole to rotate in the ground 50 and also to allow a mower deck to pass over the horizontal center portion without contacting or damaging the delineator pole. The curved center portion extends between the horizontal center portion and the top portion and creates a curved pass-through. The length of the curved center portion is such that a standard mower deck 152 or 154 can move through the curved opening to cut around the delineator pole without damaging the delineator pole.

An anchor sleeve 14 is preferably mounted on the second end of the bottom portion 10B of the delineator pole 10. The anchor sleeve 14 is preferably angled outward away from the second end of the bottom portion 10B of the delineator pole 10 such that the anchor sleeve 14 prevents the delineator pole 10 from being easily removed from a ground 50 after the delineator pole 10 is installed. The anchor sleeve 14 is preferably constructed of plastic. In one (1) embodiment, an indicator or a light reflector 18 is mounted on the top portion 10A of the delineator pole 10 to allow for easily locating the delineator pole 10.

Figure 9:
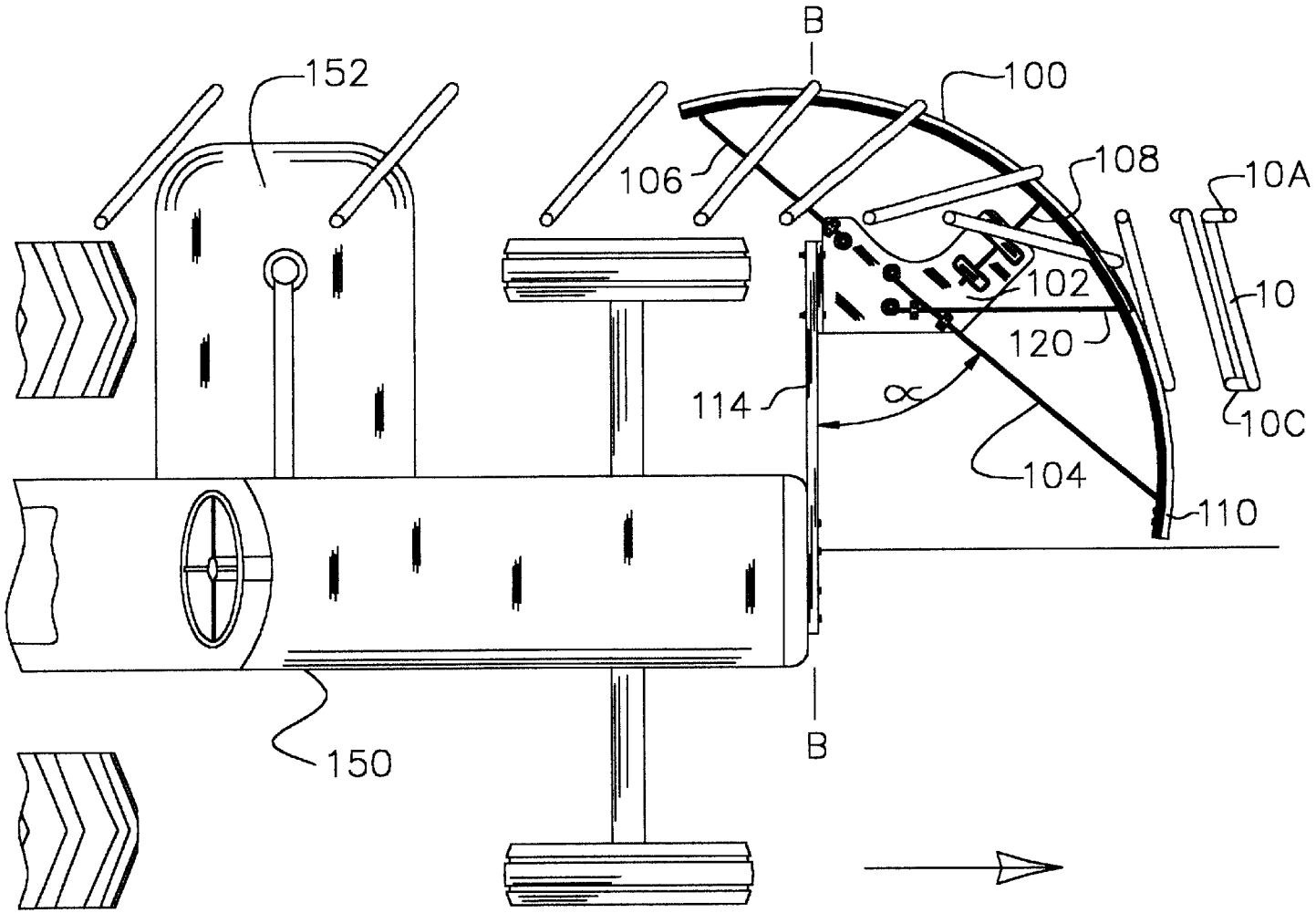
FIG. 9 is a top view of the mowing vehicle 150 with the center, off-set mowing device 152 and the mowing attachment 100.
Figure 10:
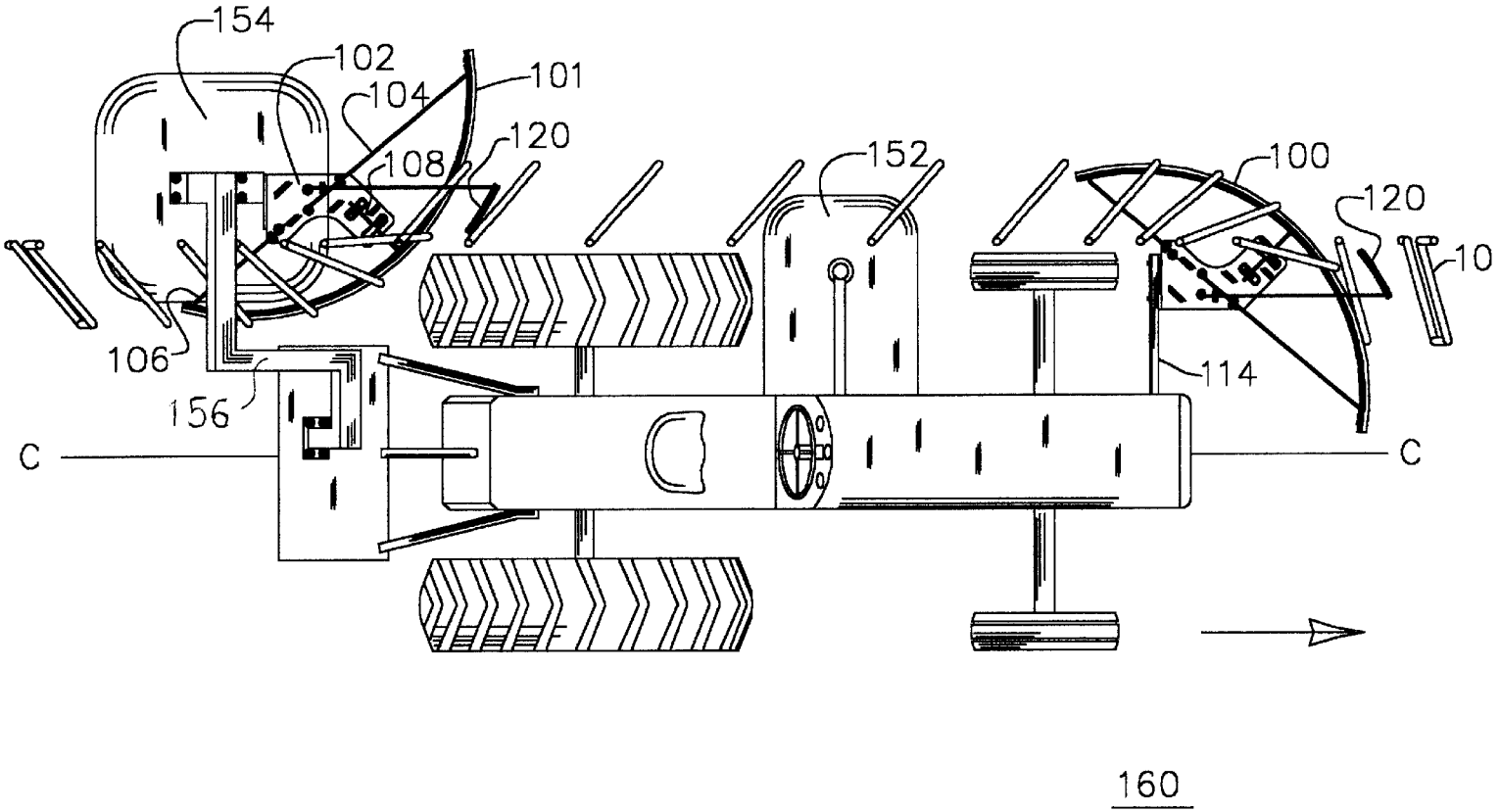
FIG. 10 is a top view of the mowing vehicle 150 with the center mowing device 152 and the rear, off-set mowing device 154 showing the first mower attachment 100 and the second mower attachment 101.

The present invention also relates to a delineator pole turning device or mower attachment 100 or 101 which mounts on a mowing vehicle or tractor 150 having at least one (1) offset mower deck or mowing device 152 or 154. In the present embodiment, the mower deck or decks 152 and 154 are mounted on a left side of the mowing vehicle 150 when viewed from a back or rear of the vehicle 150 (FIGS. 9 and 10). However, it is understood that the mower attachment 100 or 101 could also be used with mowing vehicles 150 having mowing decks 152 and 154 mounted on the right side of the mowing vehicle 150 as viewed from the rear of the vehicle 150. In one (1) embodiment, with a center mower deck 152 mounted in the middle of the vehicle 150 between the front and rear wheels of the mowing vehicle 150, the turning device 100 is mounted by an extension bar 114 to the mowing vehicle or tractor 150 (FIG. 9). The extension bar 114 is preferably a rectangular bar having opposed first and second ends. The first end of the extension bar 114 is preferably mounted on the frame of the mowing vehicle 150. The extension bar 114 extends outward toward the second end and away from the vehicle 150. The length of the extension bar 114 is such that the second end of the extension bar 114 opposite the mowing vehicle frame extends at least to an outer side of the front wheels if the mowing attachment 100 is mounted on a front of the mowing vehicle 150. In this embodiment, the mower attachment 100 is mounted on the second end of the extension bar 114 on the mowing vehicle 150 and extends outward away from the mowing vehicle 150. In another embodiment with a rear mowing deck 154 in the rear of the vehicle 150, the mower attachment 101 is mounted on the mower deck 154 or on the mounting bracket 156 for connecting the mower deck 154 to the mowing vehicle 150 (FIG. 10).

Figure 5:
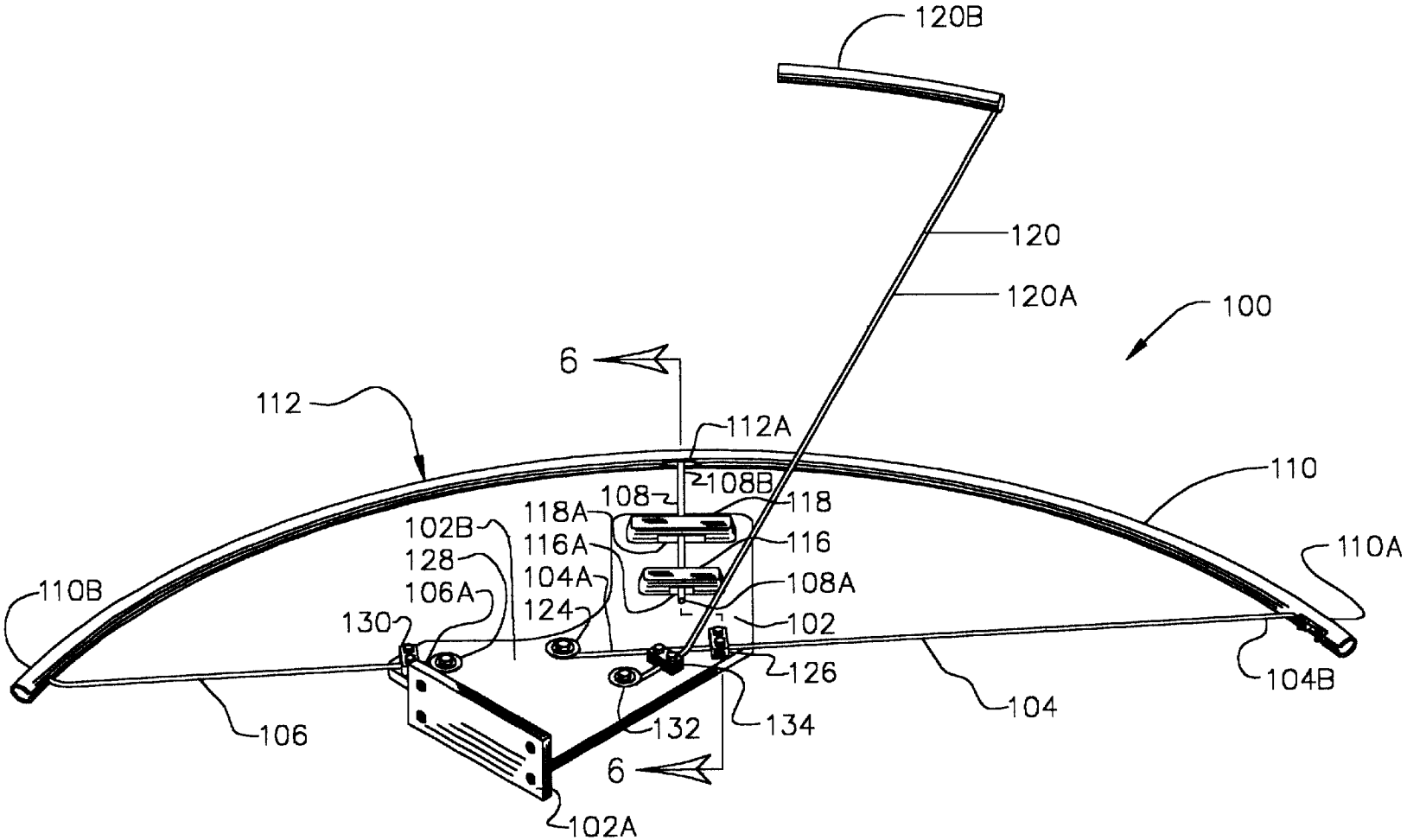
FIG. 5 is a perspective view of the mower attachment 100 of the present invention.

The mower attachment 100 or 101 includes a bracket 102, flexible connector rods 104, 106 and 108 and a bumper 110 (FIG. 5). The bracket 102 can be of a variety of shapes. In one (1) embodiment, the bracket 102 is shaped such that the bumper 110 is angled with respect to the front line of the mowing vehicle 150 or the path of the mowing vehicle 150 (FIG. 9). The bracket 102 has a first portion 102A and a second portion 102B. The first portion 102A is mounted on the first end of the second portion 102B such that the second portion 102B extends outward from the first portion 102A perpendicular to the first portion 102A. In the one (1) embodiment having the side mower deck 152, the first portion 102A of the bracket 102 is mounted on the second end of the extension bar 114 opposite the frame of the mowing vehicle 150. The first portion 102A is mounted to the extension bar 114 such that the second portion 102B extends outward perpendicular to the extension bar 114 and parallel to the ground surface 50A in a direction toward the front of the mowing vehicle 150. In another embodiment having the center mower deck 154, the first portion 102A of the bracket 102 is mounted on the mounting bracket 156 of the mower deck 154 such that the second portion 102B extends outward, parallel to the ground surface 50A in a direction toward the front of the mowing vehicle 150.

Figure 8:
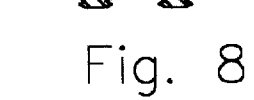
FIG. 8 is a partial cross-sectional end view along the line 8—8 of FIG. 7 showing the first connector rod 104 and the second connector rod 106 connected together by the first clamp 126.

The bumper 110 is spaced apart from the bracket 102 and connected to the bracket 102 by the flexible connector rods 104, 106 and 108. The bumper 110 has a curved shape between a first end 110A and a second end 110B and includes an inner support structure and an outer cover 112. The connector rods 104, 106 and 108 have opposed first and second ends 104A, 106A, 108A and 104B, 106B and 108B with the first ends 104A, 106A and 108A connected to the bracket 102 and the second ends 104B, 106B and 108B connected to the bumper 110. The second portion 102B of the bracket 102 is of such a size and shape as to enable the first ends 104A and 106A of the first and second connector rods 104 and 106 to be fixably mounted on the second portion 102B of the bracket 102 such that the first and second connector rods 104 and 106 extend along a common axis. In one (1) embodiment, the common axis is positioned at an angle  away from the longitudinal axis B—B of the extension bar 114 (FIG. 9). The axis B—B of the extension bar 114 is preferably perpendicular to the center line or path of the mowing vehicle 150. The second portion 102B of the bracket 102 adjacent the second end angles away from the first end such that the first end 108A of the third connector rod 108 can be slidably secured perpendicular to the common axis of the first and second connector rods 104 and 106. The first connector rod 104 is fixably connected at the first end 104A to the bracket 102 and extends outward from the bracket 102 away from the mowing vehicle 150 and toward a center line C—C of the mowing vehicle 150. The first connector rod 104 extends outward at an angle  away from the extension bar 114 (FIG. 9). In one (1) embodiment, the angle  is a 40° angle. The first end 104A of the first connector rod 104 can be secured to the bracket 102 by any well known means. In one (1) embodiment, the first end 104A is fastened to the bracket 102 using a securing nut 124 and a securing clamp 126. The second end 104B of the first connector rod 104 is connected to the inner support structure 110C of the bumper 110 at the first end 110A of the bumper 110. The first end 106A of the second connector rod 106 is fixably mounted to the bracket 102. The first end 106A of the second connector rod 106 can be secured to the bracket 102 by any well known means. In one (1) embodiment, the first end 106A is fastened to the bracket 102 using a securing nut 128 and a securing clamp 130. The second connector rod 106 extends outward from the bracket 102 to the second end 110B of the bumper 110 in a direction opposite the first connector rod 104. In one (1) embodiment, the second connector rod 106 and the inner support structure 110C of the bumper 110 are constructed as a single piece. In this embodiment, the second connector rod 106 curves along the length of the bumper 110 from the second end 110B to the first end 110A of the bumper 110 to form the inner support structure 110C of the bumper 110. In the one (1) embodiment where the second connector rod 106 forms the inner support structure 110C of the bumper 110, the second end 104B of the first connector rod 104 and the second end 106B of the second connector rod 106 are connected together at the first end 110A of the bumper 110. The ends 104A and 106A of the first and second connector rods 104 and 106 are secured together by a pair of U-shaped clamps 122 (FIG. 8). The clamps 122 allow for easy disconnect of the first and second connector rods 104 and 106 for quick and easy removal and replacement of the outer cover 112 of the bumper 110. It is understood that the first and second connector rods 104 and 106 can be connected together by any well known means. In one (1) embodiment, the distance between the bracket 102 and the first end 110A of the bumper 110 is greater than the distance between the bracket 102 and the second end 110B of the bumper 110. In one (1) embodiment, each of the first and second connector rods 104 and 106 are fixably mounted on the bracket 102 at two (2) positions.

Figure 6:
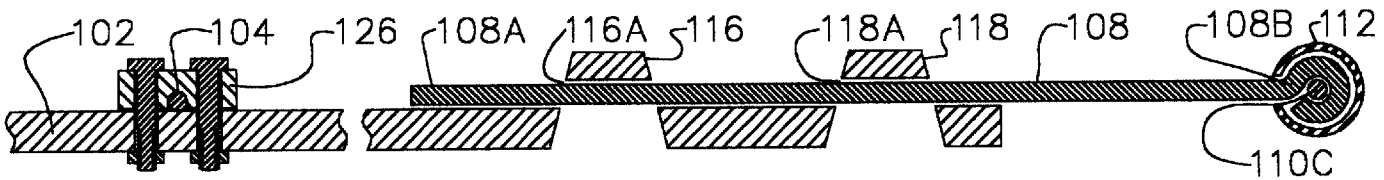
FIG. 6 is a partial cross-sectional view along the line 6—6 of FIG. 5 showing the attachment of the first connector rod 104 and attachment of the third connector rod 108 on the bracket 102.
Figure 7:
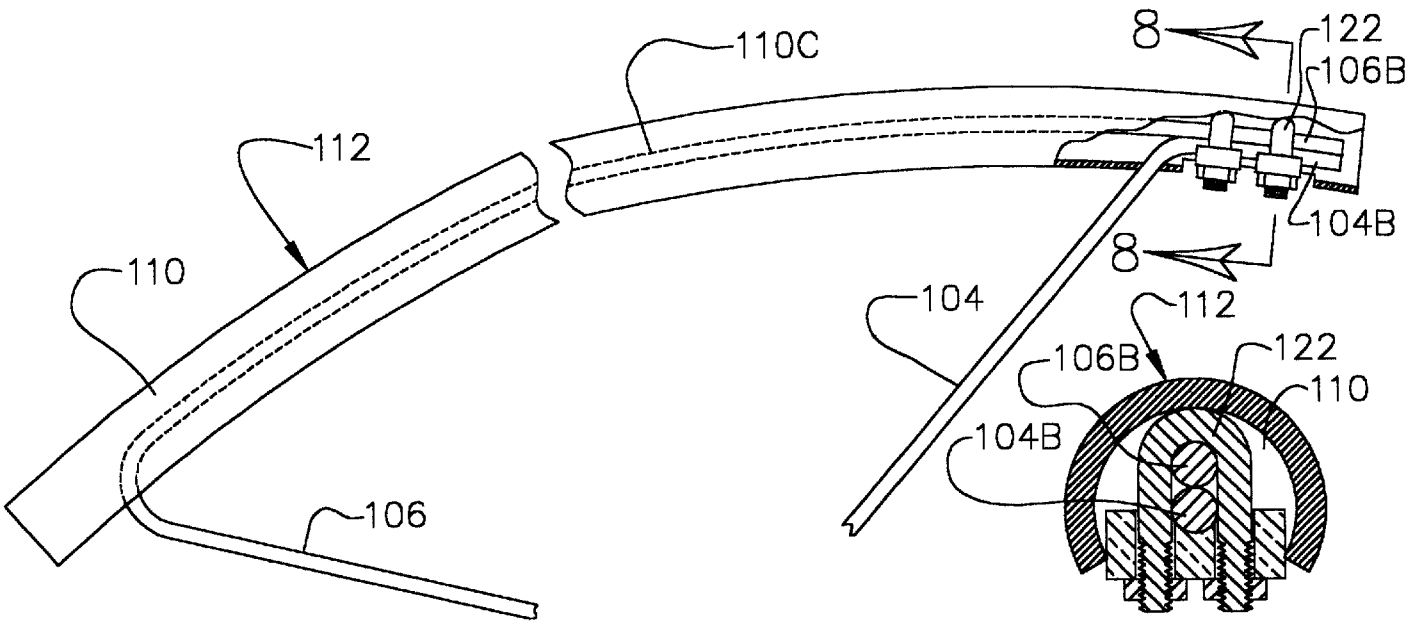
FIG. 7 is a partial view of the mower attachment 100 showing the first and second connector rods 104 and 106 and the bumper 110.

In one (1) embodiment, the second portion 102B of the bracket 102 toward the second end is angled such as to extend outward toward a center of the bumper 110. The third or center connector rod 108 is slidably connected at the first end 108A to the bracket 102. The first end 108A of the third connector rod 108 is slidably mounted to the bracket 102 by a pair of fastening blocks 116 and 118 having center openings 116A and 118A. The blocks 116 and 118 are spaced apart and parallel such that the third connector rod 108 passes through the center openings 116A and 118A of both blocks 116 and 118. The center opening 118A of the second block 118 spaced closer to the bumper 110, is longer than the center opening 116A of the first block 116. This allows the third connector rod 108 to slide a distance equal to the length of the center opening 116A of the first block 116 without contacting the second block 118 and potentially bending the third connector rod 108. The second end 108B of the third connector rod 108 is slidably connected to the inner support structure 110C of the bumper 110 spaced between the first and second ends 110A and 110B of the bumper 110. In one (1) embodiment, the third connector rod 108 is connected to the bumper 110 at a point equally spaced between the ends 110A and 110B of the bumper 110. The second end 108B of the third connector rod 108 is slidably hooked around the inner support structure 110C of the bumper 110 (FIG. 6). The outer cover 112 of the bumper 110 preferably has a slot 112A to enable the second end 108B of the third connector rod 108 to be mounted around the inner support structure 110C of the bumper 110. The outer cover 112 is of such a shape as to enable the second end 108B of the third connector rod 108 to extend around the inner support structure 110C. The slidable connection between the third connector rod 108 and the inner support structure 110C of the bumper 110 allows the bumper 110 to be replaced without replacing the third connector rod 108.

The connector rods 104, 106 and 108 are preferably constructed of spring steel rods. The flexible nature of the connector rods 104, 106 and 108 allows the bumper 110 to contact and rotate the delineator pole 10 without damaging the delineator pole 10. Further, the resilient, spring construction of the connector rods 104, 106 and 108 allows the rods 104, 106 and 108 to flex or bend when a force is applied to the bumper 110 and to return to their normal position when the force is removed from the bumper 110. The outer cover 112 of the bumper 110 is preferably a flexible, anti-wear sleeve to reduce damage to the delineator pole 10. In one (1) embodiment, the outer cover 112 is constructed of polyvinyl.

A visual indicator 120 or sight gauge can also be provided as part of the mower attachment 100 or 101. In one (1) embodiment, the visual indicator 120 has an L-shape with a long first leg 120A and a short second leg 120B. The end of the first leg 120A opposite the second leg 120B is mounted to the bracket 102. The indicator 120 can be mounted to the bracket 102 by any well known means. In one (1) embodiment, the indicator 120 is mounted similarly to the first and second connector rods 104 and 106 such as by a securing nut 132 and a securing clamp 134. The visual indicator 120 extends upward from the bracket 102. The second leg 120B extends outward essentially perpendicular to the first leg 120A in a direction toward the second connector rod 106 or the edge of the mowing vehicle 150. The end of the second leg 120B of the visual indicator 120 opposite the first leg 120A indicates the location of the outer side of the wheels of the mowing vehicle 150. The indicator 120 can be constructed of a spring steel rod to prevent damage to the indicator 120 when the indicator 120 contacts an object. The resilient, spring construction of the indicator 120 allows the indicator 120 to bend or flex when it encounters an obstacle such as to prevent damage to the indicator 120. The indicator 120 then resumes its original position when the obstacle is removed. The visual indicator 120 allows the mower operator to determine the location of the wheels of the mowing vehicle 150 with respect to the vertical axis A—A of the delineator pole 10 to prevent the wheels of the mowing vehicle 150 from contacting the delineator pole 10.

Delineator poles 10 are intended to be mounted in the ground 50 adjacent a road to designate the off-road position. The delineator poles 10 are all mounted a preset distance from the edge of the road or the edge of the emergency lane 160 such that the delineator poles 10 can be used to locate the side or edge of the road or the edge of the emergency lane 160. The delineator poles 10 are mounted in the ground 50 such that the top and bottom portions 10A and 10B are perpendicular with the ground surface 50A and the lower portion 10E is adjacent and parallel to the ground surface 50A. To mount the delineator pole 10, a hole is pre-bored for the delineator pole 10. The second end of the bottom portion 10B is then inserted into the ground 50 such that the bottom portion 10B is almost completely in the ground 50 and the lower center portion 10E is spaced only slightly above the ground surface 50A. The delineator pole 10 must be mounted such that when the delineator pole 10 rotates, the lower center portion 10E does not contact the ground surface 50A. However, the lower portion 10E is spaced adjacent the ground surface 50A such as to not contact the mower deck 152 or 154 when the mower deck 152 or 154 passes through, the pass-through 10F of the delineator pole 10 as the mowing vehicle 150 mows around the delineator pole 10. In the preferred embodiment, the hole is then backfilled with bearing material such as round silica sand. The delineator pole 10 can be tapped to settle the bearing material in place around the bottom portion 10B of the delineator pole 10. Water can also be applied to the bearing material to assist in settling the bearing material around the delineator pole 10 thus, securing the delineator pole 10 in the ground 50.

The turning device 100 or 101 rotates the delineator pole 10 out of the way of the mower deck 152 or 154 to allow for mowing around the delineator poles 10 (FIGS. 9 and 10). The delineator pole turning device 100 or 101 rotates the delineator pole 10 which positions the delineator pole 10 to allow the offset mower deck 152 or 154 of the mowing vehicle 150 to pass-through the crank opening 10F of the delineator pole 10. Preferably, the turning device 100 or 101 rotates the delineator pole 10 so that the upper and lower portions 10D and 10E of the delineator pole 10 are parallel to the front end of the mowing vehicle 150. The turning device 100 rotates a delineator pole 10 or a series of delineator poles 10 along the side of the road 160 to allow a mowing vehicle 150 having an offset mower deck or mowing device 152 or 154 to mow around and move past the delineator poles 10. Prior to mowing, the mowing vehicle 150 is positioned such that the axises A—A of the installed delineator pole 10 is positioned between the outer side of the wheels of the mowing vehicle 150 and the side of the road 160 such that the wheels of the mowing vehicle 150 will not contact the top portion 10A of the delineator pole 10. In one (1) embodiment, the mowing vehicle 150 moves along the emergency lane adjacent the road which provides a constant, level surface. In one (1) embodiment, the mowing vehicle 150 is positioned such that the center line C—C of the mowing vehicle 150 is parallel to the edge of the road or the edge of the emergency lane 160 (FIG. 10). The center portion 10C of the delineator pole 10 initially can be in any position. The initial position of the center portion 10C of the delineator pole 10 will determine how far the delineator pole 10 is rotated. The direction of rotation of the delineator pole 10 depends on which side of the delineator pole 10 the mowing vehicle 150 is passing. The rotatable nature of the delineator pole 10 and the U-shaped pass-through 10F allow for mowing around the delineator pole 10 without moving the delineator pole 10 and thus, without changing the indicator position of the delineator pole 10.

Preferably, the turning device 100 can be used with a mowing vehicle 150 having a rear mounted, offset mower deck 152 or a center mounted offset mower deck 154 or both. The turning device 100 or 101 can preferably be used with mowing vehicles 150 having the offset mower decks 152 or 154 offset to the right or the left of the mowing vehicle 150 when viewing from the rear of the mowing vehicle 150. The turning device 100 or 101 attaches to the mowing vehicle 150 on the same side as the offset mower deck 152 or 154. The turning device 100 or 101 may also be attached to the mower deck 154 itself.

In the embodiments having the mower decks 152 or 154 offset on the left side, the mowing vehicle 150 moves past the delineator pole 10 on the right side when viewed from the rear of the mowing vehicle 150. In the first example as shown in FIG. 9, the mowing vehicle 150 has a center off-set mower deck 152 with the mower attachment 100 mounted on the extension bar 114 attached to the front of the mowing vehicle 150. In this example, the center portion 10C of the delineator pole 10 is in the path or center line C—C of the mowing vehicle 150 which is to the right of the center of the bumper 110 of the turning device 100 when viewed from the rear of the mowing vehicle 150. As the mowing vehicle 150 moves toward the delineator pole 10, the section of the bumper 110 between the first and third connector rods 104 and 108 contacts the center portion 10C of the delineator pole 10. When the bumper 110 contacts the delineator pole 10, the connector rods 104, 106 and 108 flex slightly to allow the bumper 110 to rotate the delineator pole 10 in the counterclockwise direction. As the mowing vehicle 150 moves forward, the bumper 110 remains in contact with the center portion 10C of the delineator pole 10. The cylindrical shape of the delineator pole 10 and the curved shape of the bumper 110 allow the delineator pole 10 to rotate along the bumper 110. As the mowing vehicle 150 continues to move forward, the contact point between the delineator pole 10 and the bumper 110 moves from the first end 110A of the bumper 110 adjacent the first connector rod 104 to the second end 110B of the bumper 110 adjacent the second connector rod 106. As the delineator pole 10 reaches the second end 110B of the bumper 110, the delineator pole 10 has been rotated such that the center portion 10C is on the left side of the mowing vehicle 150. In this example, the delineator pole 10 will rotate in a counterclockwise direction approximately 180°. As the mowing vehicle 150 passes the delineator pole 10, the center, offset mower deck 152 moves through the U-shaped pass-through 10F and over the lower horizontal portion 10E which is spaced only slightly above the ground surface 50A and does not interfere with the mowing process.

In another embodiment as shown in FIG. 10, the mowing vehicle 150 has a center mounted offset mower deck 152 and a rear mounted offset deck 154. In this embodiment, both decks 152 and 154 are mounted on the left side of the mower vehicle 150 when viewed from the rear of the vehicle 150. The first turning device 100 is mounted on the front, left side of the mowing vehicle 150 similar to the first example and contacts the center portion 10B of the delineator pole 10 and rotates the delineator pole 10 in the counterclockwise direction which moves the center portion 10C out of the way or path of the mowing vehicle 150 and allows the center, left side offset mower deck 152 to pass through the pass-through or crank opening 10F of the delineator pole 10. As the mowing vehicle 150 continues to move forward, the second turning device 101 mounted on the rear, left side mower deck 154 contacts the center portion 10C of the delineator pole 10 and rotates the delineator pole 10 in a clockwise direction to move the delineator pole 10 out of the way of the rear, left side mower deck 154 such that the rear, left side mower deck 154 passes through the crank opening 10F of the delineator pole 10.

In another example (not shown), the center portion 10C of the delineator pole 10 is initially extending outward on a side opposite the mowing vehicle 150 toward the second end 110B of the bumper 110, left of the center of the bumper 110. Thus, the initial contact between the bumper 110 and the delineator pole 10 is adjacent the first end 110A of the bumper 110. In this example, the bumper 110 rotates the delineator pole 10 between 0° and 50°.

In another embodiment (not shown), the mowing vehicle 150 has an offset center mower deck (not shown) and a rear full mower deck (not shown). The center mower deck is offset on the right side of the mowing vehicle 150 and is mounted using a pivotable bracket which enables the mower deck to be pivoted away from the ground surface 50A into an inactive position. The mowing vehicle 150 having the mower decks offset on the right side moves past the delineator pole 10 on the left side (not shown). Positioning the mower decks on the right side of the mowing vehicle 150 allows the mowing vehicle 150 to mow in the direction of traffic as it mows along the side of a road 160. The rear mower deck is behind the mowing vehicle 150 and extends out on the right side of the vehicle 150 and is flush on the left side with the wheels of the mowing vehicle 150. The combination of side mower deck and full rear mower deck allows for more area of cut while still allowing for mowing around the delineator poles 10. In this embodiment, the mowing vehicle 150 has three (3) turning devices 100 and 101. The first turning device 101 is mounted on the front, right side of the mowing vehicle 150 and contacts the center portion 10C of the delineator pole 10 and rotates the delineator pole 10 in the clockwise direction which moves the center portion 10C of the delineator pole 10 out of the path of the mowing vehicle 150 and allows the front portion of the mowing vehicle 150 to pass the delineator pole 10. The second turning device 100 is mounted on the left, front corner of the offset center mower deck. The second turning device 100 contacts the center portion 10C of the delineator pole 10 and rotates the delineator pole 10 in the counterclockwise direction which moves the center portion 10C out of the path of the offset center mower deck and allows the offset center mower deck to pass-through the crank opening 10F of the delineator pole 10. The offset center mower deck passes on the right side of the delineator pole 10 or on the side opposite the remainder of the mowing vehicle 150. The third turning device 100 is mounted on the front, right corner of the rear mower deck. As the mowing vehicle 150 continues to move forward, the third turning device 100 contacts the center portion 10C of the delineator pole 10 and rotates the delineator pole 10 in the clockwise direction to move the center portion 10C of the delineator pole 10 out of the way of the rear mower deck such that the rear mower deck passes through the crank opening 10F of the delineator pole 10.

In the preferred embodiment, the same turning device 100 or 101 can be mounted on either the right or left side of the mowing vehicle 150 by merely flipping the center bracket 102. Further, the front mower attachment 100 is similar to the rear mower attachment 101 except that the bracket 102 is flipped over. The connector rods 104, 106 and 108 are preferably attached on the side of the bracket 102 facing upward away from the ground 50. However, the connector rods 104, 106 and 108 may be attached to any side of the bracket 102. The visual indicator 120 also needs to be moved such that it extends upward from the center bracket 102 away from the ground 50. The mowing vehicle 150 of FIG. 10 having the two (2) offset mower decks 152 and 154 and the two (2) turning devices 100 and 101 allows for cutting adjacent both sides of the delineator pole 10 in a single pass. The 360° turnable motion of the delineator pole 10 allows a mowing vehicle 150 to pass through the crank opening 10F in opposing directions, maintaining constant mowing overlap and eliminating skip spots. The devices 100 and 101 reduce the amount of damage to the ground surface adjacent the emergency lane since the mowing vehicle 150 remains on the controlled surface of the emergency lane during mowing around the delineator poles 10.

It is intended that the foregoing description be only illustrative of the present invention and that the present invention be limited only by the hereinafter appended claims.

I claim:

1. A delineator pole for use adjacent an edge of a road to indicate the edge of the road, which comprises:

(a) a first portion having a first end and a second end;

(b) a second portion spaced apart from and coaxial with the first portion and having a first end and a second end; and (c) a third portion having a first leg, a second leg and a center portion each leg having a first end and a second end with the center portion extending between the second end of the first leg and the second end of the second leg such that the third portion has a U-shape wherein the first end of the first leg is connected to the second end of the first portion and the first end of the second leg is connected to the first end of the second portion; the second portion being insertable in ground adjacent the edge of the road such that the second leg of the third portion is adjacent the ground; the delineator pole being rotatable in the ground such that a mowing vehicle will move along the edge of the road and rotate the delineator pole to allow the mowing vehicle to move through the third portion of the delineator pole to mow along the edge of the road without damaging the delineator pole and wherein when the delineator pole rotates, the first portion of the delineator pole continues to indicate the edge of the road.

2. The delineator pole of claim 1 wherein the first leg of the third portion is mounted on the second end of the first portion at an essentially 90° angle and wherein the second leg of the third portion is mounted on the first end of the second portion at an essentially 90° angle.

3. The delineator pole of claim 1 wherein an anchor sleeve is mounted on the second end of the second portion so that the second portion is able to rotate in the ground and resists removal.

4. The delineator pole of claim 1 wherein the delineator pole is constructed of a single, cylindrical rod.

5. The delineator pole of claim 1 wherein the delineator pole is constructed of a single, hollow, cylindrical tube and wherein corners of the delineator pole are provided with an inner rod to provide strength to the corners of the delineator pole to prevent bending of the delineator pole.

6. The delineator pole of claim 1 wherein the delineator pole is able to rotate in either direction.

7. The delineator pole of claim 1 wherein the first portion is provided with a reflective portion.

* * * * *